United States Patent [19]

Martel

[11] 4,227,496

[45] Oct. 14, 1980

[54] FUEL SUPPLY DEVICES FOR INTERNAL COMBUSTION ENGINES

[75] Inventor: Bernard Martel, Bagneux, France

[73] Assignee: Societe Industrielle de Brevets et d'Etudes S.I.B.E., Neuilly sur Seine, France

[21] Appl. No.: 958,813

[22] Filed: Nov. 8, 1978

[30] Foreign Application Priority Data

Nov. 10, 1977 [FR] France ..... 77 34043

[51] Int. Cl.[3] ..... F02M 7/00

[52] U.S. Cl. ..... 123/440; 123/443; 123/585; 261/23 A; 60/276

[58] Field of Search ..... 123/119 LR, 119 EC, 123/127, 32 EE; 60/276, 285; 261/23 A, 39 D

[56] References Cited

U.S. PATENT DOCUMENTS

| | | | |
|---|---|---|---|
| 4,000,614 | 1/1977 | Abthoff et al. | 123/119 LR |
| 4,051,672 | 10/1977 | Masaki et al. | 123/119 LR |
| 4,088,100 | 5/1978 | Tokura et al. | 123/127 |
| 4,125,098 | 11/1978 | Kiyota | 123/119 LR |
| 4,134,261 | 1/1979 | Iizuka et al. | 60/276 |

*Primary Examiner*—Charles J. Myhre
*Assistant Examiner*—Andrew M. Dolinar
*Attorney, Agent, or Firm*—Finnegan, Henderson, Farabow, Garrett & Dunner

[57] ABSTRACT

A fuel supply device for an internal combustion engine having at least two groups of combustion chambers, each group having a separate exhaust pipe, comprises a carburettor which delivers a mixture whose air/fuel ratio is adjusted responsive to the composition of the exhaust gases of the "richer" group. The carburettor is connected to a manifold having two branches each associated with one group. The branch feeding the "leaner" group is provided with an air/fuel ratio correction circuit comprising a solenoid valve controlled by a circuit whose input detector is located in the exhaust pipe of the "leaner" group.

2 Claims, 2 Drawing Figures

FUEL SUPPLY DEVICES FOR INTERNAL COMBUSTION ENGINES

BACKGROUND AND SUMMARY OF THE INVENTION

The present invention generally relates to a device for supplying an air-fuel mixture to an internal combustion engine having at least two groups of cylinders provided with separate exhaust pipes, comprising a single carburation device supplying the mixture to a manifold feeding the two groups of cylinders through separate branches.

Such a device is frequently used in six or eight-cylinder V engines. The maximum torque available from the engine can be increased by using two separate exhaust pipes, instead of a single exhaust manifold.

The invention more particularly relates to supply devices of the above kind in which the richness of the air-fuel mixture supplied by the carburation device is regulated according to a characteristic of the exhaust gases of the engine. This characteristic is generally the composition of the exhaust gases, which may be determined from the signal supplied by an oxygen gauge placed in the exhaust gases. From the signal supplied by the sensor, the duty ratio of electrical pulses fed to electromagnetic valves controlling the passage of fuel or air to the engine may in particular be regulated so as to maintain the richness of the mixture supplied to the engine close to stoichiometry.

According to the invention, there is provided a fuel supply device for an internal combustion engine having at least a first group and a second group of cylinders, each group having a separate exhaust pipe, comprising a manifold header having two manifold branches each adapted for connection to the cylinders of a separate one of said groups; a carburettor connected to receive air and fuel and to deliver an air-fuel mixture to said manifold header, said carburettor, manifold header and manifold branches being so arranged that the branch associated with the first group receives an air-fuel mixture which is richer than the mixture received by the manifold branch of the second group; a first probe adapted to be located in the exhaust pipe of said first group for delivering a signal indicative of the composition of the exhaust gas of said first group; a regulation circuit associated with said probe and carburettor for controlling the air-fuel ratio delivered by said carburettor in dependence of said signal; and a correction circuit having a second probe adapted to be located in the exhaust pipe of said second group for delivering a signal indicative of the composition of the exhaust gas of the second group, fuel delivery means opening into the branch associated with said second group, and means for metering the fuel flow delivered by said fuel delivery means in dependence of the signal delivered by said second probe.

The means for metering fuel may typically comprise a solenoid valve placed in the fuel delivery means and an electronic control circuit connected to said valve and second probe and constructed to maintain the signal supplied by the second probe at a predetermined value.

The invention will be better understood from the following description of a particular embodiment of a fuel supply device.

SHORT DESCRIPTION OF THE DRAWINGS

FIG. 1 is a schematic view of a V engine fitted with a supply device in accordance with the invention; and FIG. 2 is a schematical view in vertical section of the correction circuit and its connections with the carburation device.

DETAILED DESCRIPTION OF A PREFERRED EMBODIMENT

Figure 1:
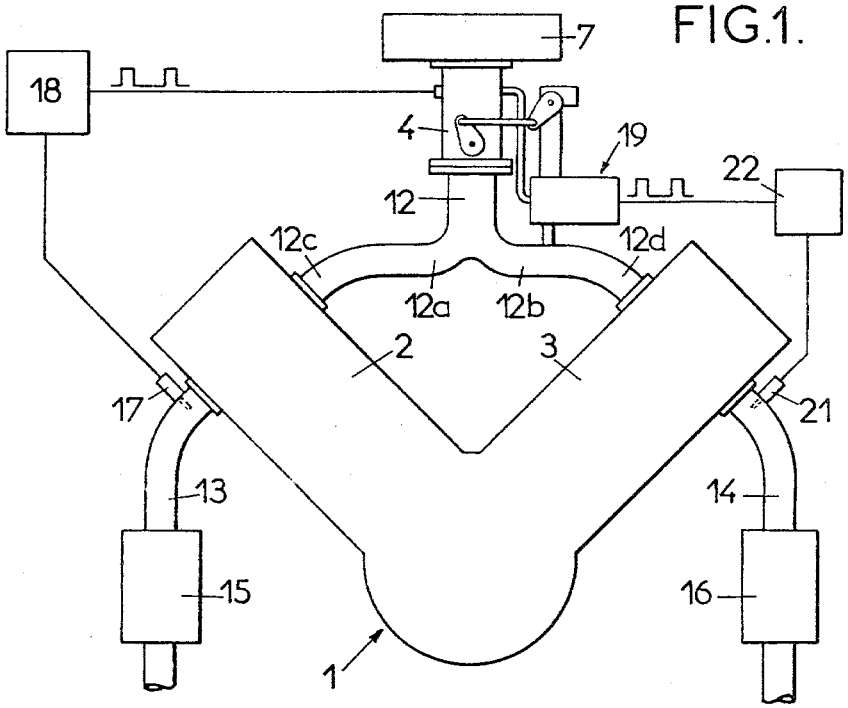

Referring to FIG. 1, there is shown an engine 1 of the V type, with two groups of cylinders 2 and 3. Engine 1 is provided with a carburation device 4 fixed on a manifold 12 forming a distribution header and which is divided into two branches **12*a* and 12*b* feeding respectively the groups of cylinders 2 and 3. Each manifold branch is subdivided in its turn into ramifications, such as 12*c* and 12 *d*, each assigned to one of the cylinders of the groups. The exhaust from groups 2 and 3 takes place through respective exhaust pipes 13 and 14, provided with catalytic chambers 15 and 16** intended to reduce the emission of pollutant gas.

Figure 2:
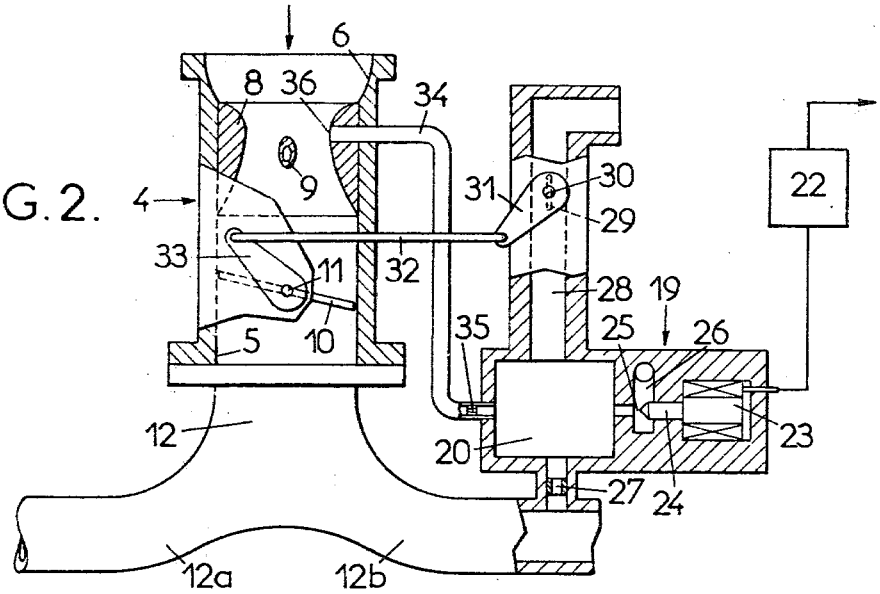

The caburation device shown by way of example in FIGS. 1 and 2 is of a conventional type. It comprises, from upstream to downstream in an intake passage 5, an air inlet 6 protected by an air filter 7, a venturi 8 in the throat of which emerges a fuel delivery system 9, and a main throttle member 10, or butterfly valve, controlled by the operator and rotating about an axis 11. The carburettor also comprises a starting device and an idling circuit, which will not be described for they have no direct relation with the invention and may be quite conventional.

Instead of being formed by a simple carburettor, the carburation device 4 may be more complex, e.g. formed by a double-barrel carburettor, or even by an arrangement of two carburettors in cascade.

It will now be assumed that cylinder group 2 is the "richer" group of the engine; the fuel-air mixture supplied to group 2 by the carburation device 4 is richer than the mixture supplied to the cylinders of the "leaner" group 3.

In the exhaust pipe 13 of the "richer" group 2, there is placed a first oxygen sensor 17 which will be assumed to be a lambda sensor which may be conventional. A lambda sensor is formed by a cell having a solid electrolyte (generally doped zirconium oxide) and platinum electrodes and it supplies a signal depending on the oxygen content of the exhaust gases. The sensor delivers a signal to the input of an electronic circuit 18 which controls, e.g. by acting on solenoid valve means (not shown), the air-fuel ratio of the mixture supplied to engine 1 by carburation device 4. Circuit 18 may for example adjust the duty ratio of rectangular square waves delivered to solenoid valves controlling the flow cross-sectional areas of fuel pipes supplying the main jet system 9 and the idling circuit of the caburation device in dependence on the value of the signal supplied by sensor 17. It is not necessary to describe here the circuit, which may for instance be of one of those described in French patent applications No. 2,228,158 and No. 2,351,269.

The above arrangement constitutes a closed loop regulation device, since the composition of the exhaust gases, measured by sensor 17, depends directly on the air-fuel ratio in the mixture delivered to group 2. It maintains an average air-fuel ratio close to stoichiometryof the mixture supplied to group 2. On the other hand, group 3 receives a mixture which is too lean from carburettor device 4.

For overcoming that deficiency, the air-fuel supply device further comprises a correction circuit for enriching the mixture supplied to group 3. In the embodiment shown, this correction circuit is included in an enrichment unit 19 which delivers a primary mixture of fuel and air having a high fuel-air ratio directly into branch 12*b* of manifold 12.

The unit 19 may be readily mounted on branch 12*b*. Referring to FIG. 2, unit 19 comprises a body made from a plurality of assembled parts, in which there is provided a main fuel chamber 20 connected to branch 12*b* of the intake manifold by a calibrated restricted orifice 27. Chamber 20 receives fuel, e.g. from the float chamber of the carburettor device, through a fuel pipe 26 which has a control section 25 which is closed by the moving part 24 of a solenoid valve 23 when the latter is de-energized.

The adjustment range which is provided by a solenoid valve is limited. The enrichment unit 19 is arranged to allow regulation of the depression which prevails in the main chamber 20 and consequently to increase the range of adjustment available. Further components are provided for that purpose. In the embodiment of FIG. 2, they comprise a pipe 28 which connects chamber 20 to an atmospheric air pressure source and whose flow cross-sectional area is controlled by an auxiliary throttle member 29 formed by a butterfly valve rotatable about an axis 30 and operatively connected to butterfly valve 10 of the carburation device by a mechanical linkage comprising a lever 31, a link 32 and a second lever 33 secured to butterfly valve 10. The linkage is so arranged that the cross-sectional area limited by member 29 varies inversely to that limited by butterfly valve 10 in the induction passage 5 of the carburation device 4. The means for regulating the depression further comprise a pipe 34 provided with a calibrated orifice 35, which connects chamber 20 to an orifice 36 at the throat of the venturi 8 of the carburation device.

The detection means of the correction circuit 22 is formed by a sensor 21, similar to sensor 17 and mounted on the exhaust pipe 14 of the second group 3. Solenoid valve 23 is controlled, depending on the signal supplied by sensor 21, by a second electronic circuit 22 which controls the duty ratio of solenoid valve 23. Circuit 22 may be similar to circuit 18.

The operation of the device is the following:

When the engine is idling, butterfly valve 10 is closed (as shown in FIG. 2) and throttle member 29 is wide open. Chamber 20 is connected to the atmospheric pressure by channel 28 whose cross-sectional area is very much greater than the cross-sectional area of orifice 27 connecting chamber 20 and the manifold branch (where a substantial depression prevails); furthermore, the pressure transmitted by pipe 34 is substantially equal to the atmospheric pressure; therefore, the pressure in fuel chamber 20 will be close to the atmospheric pressure. There will be practically no depression exerted on the passage section 25 of fuel channel 26; the second electronic circuit 22 will determine the duty ratio (or aperture ratio) of solenoid valve 23, in response to the signal from lambda sensor 21, so as to give to cylinder group 3 the low enrichment required for idling.

If the engine is loaded by partially opening butterfly valve 10, the depression at the throat of the venturi 8, transmitted by pipe 34, increases and throttle member 29 assumes a more closed position; the flow cross-sectional area which it limits in channel 28 is reduced, for example to a size comparable to that of the flow cross-sectional area of the calibrated orifice 27. Since the depression in manifold branch 12*b* is still relatively high, a greater amount of depression will prevail in chamber 20. The two actions will cooperate in increasing the depression in chamber 20, which is transmitted to fuel channel 26: for an equal duty ratio of electromagnetic valve 23, more fuel will be drawn in by the engine and the enrichment will be greater.

The amount of enrichment fuel to be supplied by the enrichment unit 19 typically varies in the ratio from 1:1 to 30:1 between idling and the highest load of the engine for which the device described above operates as a "closed loop".

The change in the duty or aperture ratio of solenoid valve 23 can hardly provide a range of variation exceeding about 1:1 to 4:1. The modulation of the pressure in fuel chamber 20 allows a range of sufficient width to be attained.

Numerous embodiments of the invention will be readily apparent to those familiar with the art: the device may be constructed to supply an engine comprising more than two groups of cylinders. Then, the carburation device will be controlled from a sensor placed in the exhaust gases of the "richer" group and there will be provided as many correction circuits as remaining groups. The components may have forms different from those which have been described and in particular the linkage connecting the butterfly valve and throttle member 29 may comprise a resilient coupling.

I claim:

1. A fuel supply device for an internal combustion engine having at least a first group and a second group of cylinders, each group having a separate exhaust pipe, comprising;

a manifold header having two manifold branches each adapted for connection to the cylinders of a separate one of said groups;

a carburettor connected to receive air and fuel and to deliver an air/fuel mixture to said manifold header, said caburettor, manifold header and manifold branches being so arranged that the branch associated with the first group receives an air/fuel mixture which is richer than the mixture received by the manifold branch of the second group;

a first probe adapted to be located in the exhaust pipe of said first group for delivering a signal indicative of the composition of the exhaust gas of said first group;

a regulation circuit associated with said probe and carburettor controlling the air/fuel ratio delivered by said carburettor in dependence of said signal;

and a correction circuit having a second probe adapted to be located in the exhaust pipe of said second group for delivering a signal indicative of the composition of the exhaust gas of the second group;

fuel delivery means opening into the branch associated with said second group;

and means for metering the fuel flow delivered by said fuel delivery means in dependence of the signal delivered by said second probe;

wherein the means for metering fuel are included in an enrichment unit comprising a chamber connected to the manifold branch of said second group by a calibrated restrictor, to a fuel feed pipe means by a solenoid valve controlled by an electronic control circuit connected to said valve and second probe and constructed to maintain the signal from the second probe at a predetermined value, to a source of air by air pipe means provided with an auxilliary throttle member operatively associated to an operator operable throttle member of the carburettor, whereby the air flow cross-sectional areas offered by the auxilliary throttle member and by the operator operable throttle member vary in opposite directions, and to the throat of a venturi provided in the air induction passage of the carburettor.

2. A device according to claim 1, wherein the electronic control circuit is constructed for supplying periodic opening signals with a variable duty ratio to the solenoid valve.

* * * * *